US010464731B2

(12) United States Patent
Grogan

(10) Patent No.: US 10,464,731 B2
(45) Date of Patent: Nov. 5, 2019

(54) TEMPERATURE CONTROLLED TRANSPORT ENCLOSURE WITH TRACKING TECHNOLOGY UTILIZING THERMOELECTRIC DEVICES

(71) Applicant: Charles Paul Grogan, Franklin, TN (US)

(72) Inventor: Charles Paul Grogan, Franklin, TN (US)

( * ) Notice: Subject to any disclaimer, the term of this patent is extended or adjusted under 35 U.S.C. 154(b) by 197 days.

(21) Appl. No.: 15/481,530

(22) Filed: Apr. 7, 2017

(65) Prior Publication Data

US 2018/0009588 A1 Jan. 11, 2018

Related U.S. Application Data

(60) Provisional application No. 62/390,736, filed on Apr. 7, 2016.

(51) Int. Cl.

| | |
|---|---|
| ***F25B 21/04*** | (2006.01) |
| ***B65D 81/18*** | (2006.01) |
| ***F25B 21/02*** | (2006.01) |
| ***F25D 29/00*** | (2006.01) |
| *B65D 81/38* | (2006.01) |
| *F25D 11/00* | (2006.01) |

(52) U.S. Cl.

CPC ..... *B65D 81/18* (2013.01); *F25B 21/02* (2013.01); *F25B 21/04* (2013.01); *F25D 29/00* (2013.01); *B65D 81/3825* (2013.01); *F24F 2221/48* (2013.01); *F25D 11/003* (2013.01); *F25D 2331/809* (2013.01); *F25D 2700/08* (2013.01)

(58) Field of Classification Search

CPC ..... B65D 81/3825; F25B 21/02; F25D 11/003

See application file for complete search history.

(56) References Cited

U.S. PATENT DOCUMENTS

| | | | | |
|---|---|---|---|---|
| 5,802,863 | A | 9/1998 | Cowans | |
| 6,474,093 | B1 * | 11/2002 | Fink | F25D 17/02 62/376 |
| 6,968,711 | B2 | 11/2005 | Smith | |
| 7,254,952 | B2 | 8/2007 | Lilke | |
| 8,061,148 | B2 | 11/2011 | Ethier | |
| 8,412,489 | B2 | 4/2013 | Kadaba | |
| 8,516,849 | B2 | 8/2013 | Mooijer | |
| 8,887,944 | B2 | 11/2014 | Deane | |
| 2006/0213206 | A1 | 9/2006 | Linder | |
| 2007/0028642 | A1 | 2/2007 | Glade | |

(Continued)

*Primary Examiner* — Filip Zec

(74) *Attorney, Agent, or Firm* — Carrithers Law Office, PLLC; David W. Carrithers

(57) ABSTRACT

A portable, self-contained, temperature-controlled enclosure capable of maintaining a constant, user-specified temperature within the enclosure independent of the outside environment. The device is ideal for the transport of material that is highly temperature sensitive and requires a stable temperature environment. The portable enclosure includes capability of cellular and GPS location beacon identification, comprehensive internal status and operation monitoring, and wireless communication capability of the device status, temperature and humidity parameters, and location using BLUE TOOTH, WIFI and/or cellular technology. The system is powered by an onboard rechargeable battery, external DC power, or external AC power.

13 Claims, 9 Drawing Sheets

(56) References Cited

U.S. PATENT DOCUMENTS

| | | | |
|---|---|---|---|
| 2009/0145138 | A1 | 6/2009 | Ethier |
| 2012/0271742 | A1 | 10/2012 | Solomon |
| 2013/0305663 | A1 | 11/2013 | Matson |
| 2014/0052412 | A1 | 2/2014 | Kadaba |
| 2014/0144161 | A1 | 5/2014 | Pointer |
| 2014/0157794 | A1 | 6/2014 | McGann |
| 2014/0250918 | A1 | 9/2014 | Lofy |

* cited by examiner

TEMPERATURE CONTROLLED TRANSPORT ENCLOSURE WITH TRACKING TECHNOLOGY UTILIZING THERMOELECTRIC DEVICES

This application claims priority from U.S. Provisional Patent Application No. 62/390,736 filed on Apr. 7, 2016 which is incorporated by reference herein in it's entirety.

TECHNICAL FIELD

The present invention relates to the field of portable containers capable of maintaining the contents at a selected temperature and transmitting the location, status and health of the contents using the cellular communication network using GPS tracking to determine the present location.

BACKGROUND OF THE INVENTION

Quality problems may occur when transporting wines, beer, or other temperature sensitive beverages, food, medicines, or other biodegradable materials if the products are subjected to temperatures above a level resulting in degradation of the product. Even variable temperature levels or humidity levels may result in damage to some products. For instance, it is desirable to maintain a pre-selected temperature range for maintaining the integrity of wines. Storing and serving wines at the proper temperature is important in capturing the many qualities that wine has to offer.

On occasion, wines must be transported when a distributor travels between overnight destinations. Wine distributors and salesman meet with potential customers from in various locations on a daily basis with the task of introducing the merchants to new wine products. The wines must be readily available and maintained at a ready to serve optimum temperature. Storing and transporting red wine in at the proper temperature is critical to capturing the many qualities that wine has to offer.

As an example, an acceptable temperature range for storing red wine might be approximately 55° F. The optimal drinking temperatures for different types of red wine may range from 45° to 66° F.

In addition to temperature control, the ability to track the temperature and location of the temperature controlled container and/or bottles, cans, or individual containers of product therein, and transmit this information to a selected recipient via electronic means is an important to make sure the wine or other temperature sensitive product is held and stored at an acceptable temperature range.

Conventional transport cases teach various devices for controlling the temperature of transported products. US Patent Publication No. 20070028642 by Glade et al teaches a reusable container for transporting temperature controlled items including an outer case and lid defining a well, both with insulating layers and at least one cooling element disposed within the well. The cooling element is separately removable and freezable. A removable caddy is provided in the well.

U.S. Pat. No. 7,178,343 by Linder teaches a cabinet preferably made from wood including a base and a lid with a bottle tray positioned within an upper area of the base. The bottle tray includes a plurality of semicircular recesses formed in the tray, each of which are adapted to receive a wine bottle. A plurality of circulation slots are disposed through the bottle tray for assisting with air circulation within the wine cooler. The wine cooler further includes a thermoelectric cooling system comprising at least one thermoelectric couple, each thermoelectric couple having a cold and hot junction. The system operates from a 12 VDC source.

U.S. Pat. No. 8,412,489 by Gadaba teaches a system including an environmental sensor that can travel with a product within a carrier's logistics network. The environmental sensor being configured to sense an environmental condition capable of affecting the product to generate product environment data. The system includes a scanner configured to read product environment data from the environmental sensor. The system also includes a hub control unit configured to communicate with the scanner and receive the product environment data from the scanner and determines whether the product environment data transcends a limit of exposure of the product to an environmental condition. The hub control unit is also configured to generate a transporting instruction to redirect transport of the product to an alternate destination different from its original destination if the hub control unit determines that the product environment data indicates the environmental condition of the product has transcended the limit of exposure.

U.S. Pat. No. 8,061,148 teaches a portable temperature controlled container defining a storage chamber with a cold side assembly system in heat transfer communication with the interior of the chamber and a hot side assembly system in heat transfer communication with the interior of the chamber and a thermoelectric module supplied with electrical power.

SUMMARY OF THE INVENTION

The present invention relates to the field of portable containers capable of maintaining the contents at a selected temperature and transmitting the location, physical parameters and status of the contents using GPS tracking to determine the present location and electronic means for monitoring the physical parameters and location.

The device consists of a portable, self-contained, temperature-controlled enclosure capable of maintaining a constant, user-specified temperature within the enclosure independent of the outside environment. The device is ideal for the transport of material that is sensitive to its temperature and desires a stable temperature environment. The device has the ability to maintain a stable, fixed temperature in an insulated enclosure through the use of thermo-electric technology for heating and cooling of the enclosure. Programmable electronic controls are used to set, monitor, and drive the thermo-electric devices. Various options are utilized to provide user interface, display temperatures, alarm points, and operating status. The device is powered by both AC wall power and self-contained, rechargeable battery power. The length of time the device can operate under battery power only is determined by the battery size and the internal temperature set point. The device can also be powered from 12 VDC accessory outlets in vehicles. Advanced versions of the device add the optional capability of cellular and GPS location beacon identification, comprehensive internal status and operation monitoring, and wireless communication capability of the device status and health.

In accordance with the present invention, the portable container comprises a portable and rechargeable temperature controlled case comprising, consisting of, or consisting essentially of a sealable enclosure partitioned into a plurality of subassembly modules and having a thermal cavity formed therein in thermal communication therewith, wherein the thermal cavity has four insulated cooler walls, an insulated top lid and a base connecting to the walls. The base includes a thermal manifold having a top surface defining the bottom surface of the thermal cavity. A plurality of Peltier devices are connected in thermal communication with the thermal manifold. A heat sink is connected in thermal communication to the bottom surface of the plurality of Peltier devices. The case includes following subassemblies: a temperature controller with an integral user interface wherein the temperature controller controls the plurality of Peltier devices in order to maintain a target temperature within the thermal cavity. The case also includes a thermal transfer device for heating or cooling the thermal cavity. The thermal transfer device includes the Peltier devices, the thermal manifold and the lower heat sink.

The case includes a power supply module, a rechargeable battery in electrical communication with the power supply, the thermal transfer device, and an auxiliary electronics module. The enclosure comprises an external case including four walls extending upward from a base, a lid and a subassembly of modules and the thermal cavity for removably holding temperature sensitive articles. The first lid cooperatively engaging the thermal cavity for forming an air tight seal with a top edge of the insulated walls of the thermal cavity. At least one side handle extends from an outside surface of at least one side wall of the enclosure. A top handle extends from a top portion of a selected side wall.

A system processor such as a desktop computer, a laptop computer, a smart phone, a pad-type computer, or any other digital processor, is typically used to control the modules and instruments. Information can be transmitted and received wirelessly by a system processor of keyboard or touch screen. The temperature controller and location system includes GPS location tracking device, USB connectivity, and BLUE TOOTH and/or WIFI connectivity capable of transmitting instantaneous thermal cavity temperature and humidity and history at selected intervals which can be reviewed by a smart device or through an internet connection connected to devices including smart devices such as tablets, phones, laptop computers, and WIFI capable computers. The information can be provided in real time or recorded. The enclosure location at any particular time can be provided and/or recorded as well.

The present invention provides a portable, self-contained, automatic temperature controlled enclosure, ("ATCE") referred to herein as the ATCE carrier. The ATCE carrier is partitioned into major subassembly modules: temperature controller, thermo-electric module, power supply module, battery, and auxiliary electronics module. The enclosure includes a cavity which holds the items whose temperature is to be controlled, a lid, insulation around the walls of the cavity, and in the lid, an external case surrounding and containing all of the subassembly modules and the cavity. The external case includes wheels or casters at the bottom four corners, side handles and a top handle for pulling the ATCE carrier.

A preferred embodiment of the device comprises or consists of a portable and rechargeable temperature controlled wine case. The case comprises an enclosure partitioned into a plurality of subassembly modules including a temperature controller, a thermo-electric module for heating or cooling the thermal cavity, a power supply module, a rechargeable battery in electrical communication with the power supply, the temperature controller and the thermo-electric module, and an auxiliary electronics module. The enclosure includes four walls extending upward from a base forming an external case having a plurality of subassembly modules therein for removably holding temperature sensitive articles therein. A lid cooperatively engages the thermal cavity forming an air tight seal with the top edge of the walls of the thermal cavity. An insulating material surrounds the walls, the lid, and the base. An external case surrounds the enclosure. A plurality of wheels or casters can be mounted to the bottom portion of the enclosure. A least one side handle extends from an outside surface of at least one side wall. A top handle extends from a top portion of a selected side wall. The enclosure includes a GPS location beacon and means for cellular communication such as a BLUE TOOTH, WIFI or a cell phone.

It is an object of this invention to provide a portable, self-contained, automatic temperature-controlled enclosure which is self powered by a rechargeable battery which can be recharged by external 12 VDC power or external 110 VAC power.

It is an object of this invention to provide a portable, self-contained, automatic temperature-controlled enclosure which is sized as carry-on luggage.

It is an object of this invention to provide a portable, self-contained, automatic temperature-controlled enclosure which can control the temperature of a few bottles of wine in a given temperature range.

It is an object of this invention to provide a portable, self-contained, automatic temperature-controlled enclosure which includes electronic hardware allowing communication with BLUE TOOTH, WIFI and cellular devices such as cell phones and personal computers.

It is an object of this invention to provide a portable, self-contained, automatic temperature-controlled enclosure which provides signaling the present location using GPS technology to a smart device such as a cell phone.

It is an object of this invention to provide a portable, self-contained, automatic temperature-controlled enclosure which provides for signaling the present temperature and historical temperature information if desired to a smart device.

It is an object of this invention to provide a portable, self-contained, automatic temperature-controlled enclosure which provides for signaling the present temperature alarm and alert information to cell phones.

The ATCE carrier is capable of maintaining a constant, user-specified temperature within the thermal cavity independent of the outside environment. The device is ideal for the transport of material that is sensitive to its temperature and requires a stable temperature environment. The size and shape of the thermal cavity can be chosen to accommodate various sized materials that need to be both transported and maintained at a constant temperature. The preferred general size and shape of the ATCE carrier is similar to an airline carry-on rolling bag. The device has the ability to maintain a stable, fixed temperature in an insulated thermal cavity through the use of thermo-electric technology for heating and cooling of the thermal cavity. Programmable electronic controls are used to set, monitor, and drive the thermo-electric devices. Various options are utilized to provide user interface, display temperatures, alarm points, and operating status.

The ATCE carrier is powered by either AC wall power or by a self-contained, rechargeable battery power. The length of time the device can operate under battery power only is determined by the battery size and the internal temperature set point. The device can also be powered from 12 VDC accessory outlets in vehicles. Rechargeable means such as a solar panel may be incorporated therein.

An important feature of the device is the capability of cellular communication and GPS location beacon identification, comprehensive internal status and operation monitoring, and wireless communication capability of the device status and health. The device can communicate with a user's cell phone using BLUE TOOTH or WIFI communication to transmit the thermal cavity temperature and can create an alarm to alert the user to a possible undesirable temperature situation. Further, the device can include a cellular phone capable of automatically calling programmed numbers to alert selected individuals of the present location and internal temperature or the device can be dialed up by another cell phone and to determine the present location and internal temperature.

The user opens the top cover turning on the device through the operator's panel, and setting the desired temperature via buttons on the temperature controller, using the display to view the settings. Once set, the user would place his material requiring transport into the cavity, and then close the cover. Operating instructions for the device will recommend that the material to be transported already be at or close to the desired temperature from its non-portable storage location. This will maximize the operational time of the device.

The user has the option of using battery power (internal self-powered), vehicle power through an accessory 12 VDC connection, or normal household AC power through a wall outlet and power cord when available. The device will sense what type of power is being used and control operations accordingly. When the device nears the end of its battery charge, a warning is issued to the user. When the device reaches the end of its operating time (self-powered), or experiences an operating problem, an alarm will be sent prior to going into shutdown mode to again alert the user, so that preventive measures may be taken.

When the user is ready to remove the materials, he simply opens the cover and removes the material from the cavity. At this point, there is the option to allow the device to continue running if desired (anticipating a future need), or simply to turn the unit off if it will not be needed. The device must be plugged into AC power to properly charge the internal batteries.

The device includes options such as cellular communication and GPS and will have additional user-prompted controls for custom programming. Such programming will require connection through USB cable to an external smart device. These operating modes would be detailed in the owner's manual.

The size and shape of the thermal cavity can be changed to accommodate various size materials that need to be both transported and maintained at a constant temperature. The general size of the prototype ATCE Carrier is that of a 16 quart portable cooler. The device has the ability to maintain a stable, fixed temperature in an insulated thermal cavity through the use of thermo-electric technology for heating and cooling of the thermal cavity. Programmable electronic controls are used to set, monitor, and drive the thermo-electric devices. Various options are utilized to provide user interface, display temperatures, alarm points, and operating status.

The ATCE carrier is partitioned into major subassembly modules: Temperature Controller, Thermal Transfer device/Thermal cavity module, Power Supply/Thermal Chimney module, Battery, Auxiliary Electronics module, and Carrier Enclosure. Functionality of these modules is detailed below.

Temperature Controller

The Temperature Controller consists of a programmable thermostatic controller that incorporates remote temperature sensing and closed loop heating/cooling control outputs. The controller contains a visual display and user controls for the current temperature and the set point temperature, temperature alarm settings, and thermostat control function settings. The user interface is primarily through this module for the programming of desired temperature and allowable temperature range for the material being transported. This module utilizes 12 VDC system power for operation and provides controlled outputs for the heating and cooling signals to the Thermo-Electric module. The controller operates similar to a precision programmable thermostat, issuing a cooling control signal when the device cavity temperature is above the user-defined set point, and issues a heat control signal when the device cavity temperature is below the set point. The alarm set points are user defined and can signal if the temperature in the cavity deviates beyond the range defined by the user.

Power Supply/Thermal Chimney Module

The power supply and thermal chimney module utilizes an off-the-shelf commercial appliance-rated switching power supply to convert AC line voltage input to regulated 12 VDC internal power. This provides internal operating power and charging power to the battery module. The power supply is of high-efficiency switching design, and includes over voltage, undervoltage, overcorrect, and operating temperature protection within the module. The charging power for the battery is routed through the auxiliary electronics module where it is monitored and controlled. The basic off-the-shelf power supply is available from multiple suppliers in the same form factor and power rating.

The power supply is housed in a thermal heat chimney designed to draw outside ambient air into the power supply and exhaust the waste heat external to the Carrier enclosure. This is facilitated by at least one fan that draws air across a custom heat sink 44 attached to the power supply thermal interface. The use of the Thermal Chimney minimizes any effects of waste heat from the power supply from heating the internal space of the Carrier enclosure.

Thermal Transfer Device/Thermal Cavity Module

The Thermal Transfer device/Thermal cavity module is a bi-directional heating, cooling, and energy transfer device based upon the Peltier effect for thermal energy conversion. In the device, this module is a bi-directional heat flow transfer device, consisting of multiple industrial thermo-electric coolers (TEC), or Peltier devices, mounted to transfer device/thermal cavity assembly consisting of a custom heat sink on one side and an application-specific custom heat manifold on the other side. The heat transfer device transfers the cooling or heating energy from the TEC devices through the manifold and radiates it to the cavity. The temperature is monitored in the cavity for feedback to the Temperature Controller. The bi-directional heat flow capability is facilitated through the polarity of power applied to the TEC devices. Power routing to the module flows through the Auxiliary Electronics module, controlled by the Temperature Controller and user interface. The heat sink and thermal transfer device/enclosure utilize high thermally-conductive aluminum alloys to efficiently move heat through the TEC system to the cavity utilizing a combination of conductive and convective heat transfer principles. Forced air flow for the heat sink side is provided by a ducted fan controlled through from the Auxiliary Electronics module. The forced air is vented to the outside to prevent heat buildup inside the ATCE carrier enclosure. This module is an integral part of the internal cavity and the manifold is uniquely designed to maximize thermal flow from the TEC devices to the cavity space.

This module employs construction designed to create a 5-sided thermal cavity, with an insulated, thermally reflective top cover. Special channels are machined into the primary transfer surface (top surface) of the bottom of the thermal that increase the surface area for contact conduction and open convective heat transfer. The side walls of the transfer device/thermal cavity are welded together via tig welds 47 and to the primary thermal transfer surface to provide a low thermal-resistance path for energy transfer throughout the cavity. The bottom of the thermal cavity includes a lower heat sink and an upper thermal manifold with at least one TEC device connecting the two. The TEC device is a Peltier heat pump which can move heat either from the lower heat sink upward to the thermal manifold or can move heat from the thermal manifold downward to the lower heat sink. The lower heat sink is situated in a plenum with a fan which circulates ambient (room) air over the lower heat sink.

Battery Module

The Battery module provides power to the device when it is being transported. The Battery module utilizes off-the-shelf commercial sealed, lead-acid (SLA), deep cycle batteries in a parallel connection arrangement. The amp-hour rating is sized for the planned utilization time of the device, and multiple batteries are used for extended operation. Connectors are utilized to facilitate ease of replacement of the batteries in the system. Charging of the batteries is controlled through the Auxiliary Electronics module.

Auxiliary Electronics Module

The Auxiliary Electronics module contains electronic circuitry to tie together the electrical controls within the device, power routing, and the housing and powering of optional functions such as GPS location beacons and cellular communications. This module consists of a circuit board assembly containing the control circuitry, connectors for interface to the device, power switching relays for power control, and voltage conversion where required to supply functions that require voltages other than 12 VDC.

Power from the Power Supply module, Battery module, and external 12 VDC vehicle power input are routed through this module where they are monitored, controlled, and routed as required to the other modules in the device. Status monitoring of the power mode being utilized, battery charging and battery module health, internal device temperature safety controls, and option module control and power are contained in the module.

For optional high-end versions of the device, a programmable controller function is included in the circuit board that provides enhanced control and interface functions. This controller is accessed through USB connection to the top control panel user interface. The controller uses pre-installed firmware to control the functions of the device.

Carrier Enclosure

The Enclosure is constructed in a manner similar to a dual-wall, foam cavity portable cooler. Cooler wall conduits and penetrations are made for airflow inlets via front inlet grill and outlets and external power connections. The enclosure, from hereon, also referred to as the automatic temperature controlled enclosure (ATCE) carrier utilizes a top panel for unit controls, monitoring, and access to the temperature controlled cavity. Access to the top panel is made by simply opening the lid to the enclosure. Additional foam insulation panels or pads with reflective foil are utilized around the thermal transfer device or thermal cavity subassembly to further stabilize the thermal cavity temperature-controlled cavity and to force the convective heat/cool energy transfer to the desired thermal cavity space. Internal areas with controlled airflow cavities are mounted in the cooler thermal cavity with foam edge boundaries, which effectively seal the areas against airflow escape. This insulation, along with the dual-wall cooler thermal cavity construction, provide resistance against external ambient temperatures.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
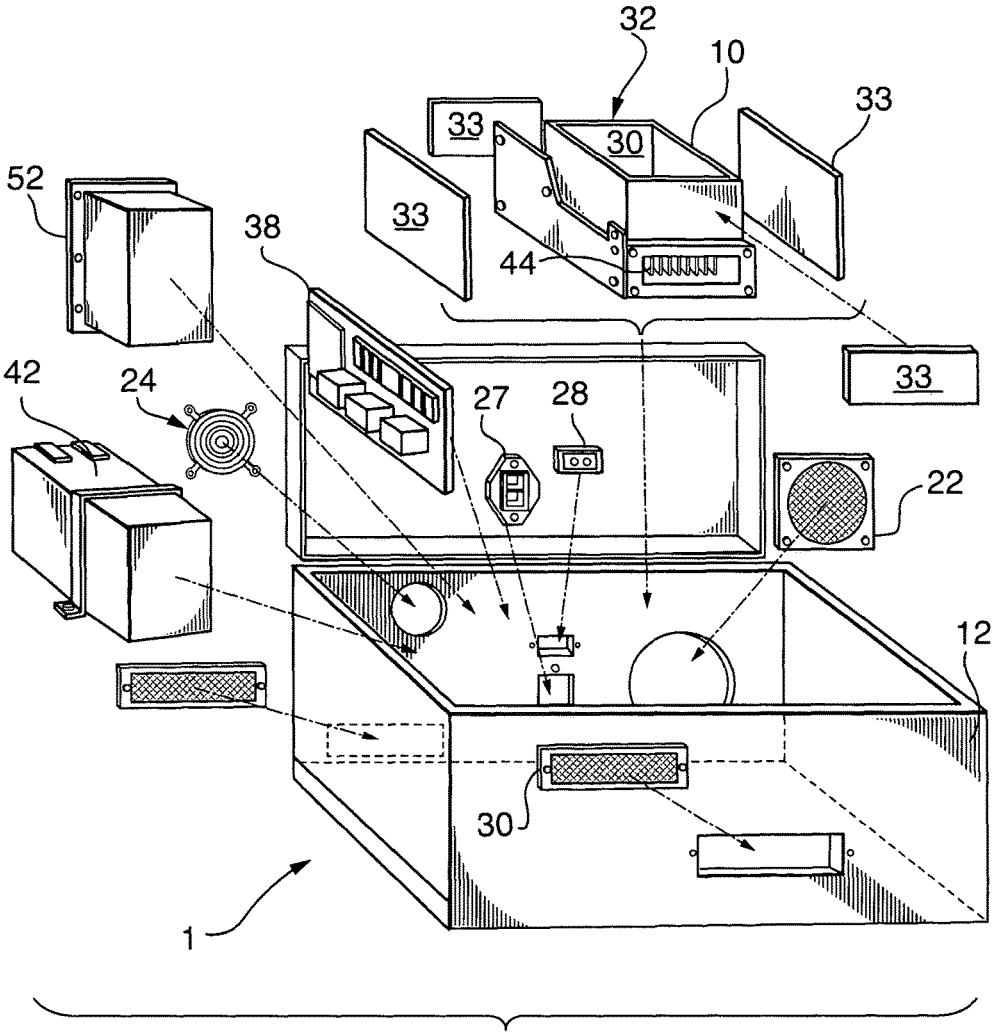
FIG. 1 is an exploded perspective view of the ATCE carrier.
Figure 2:
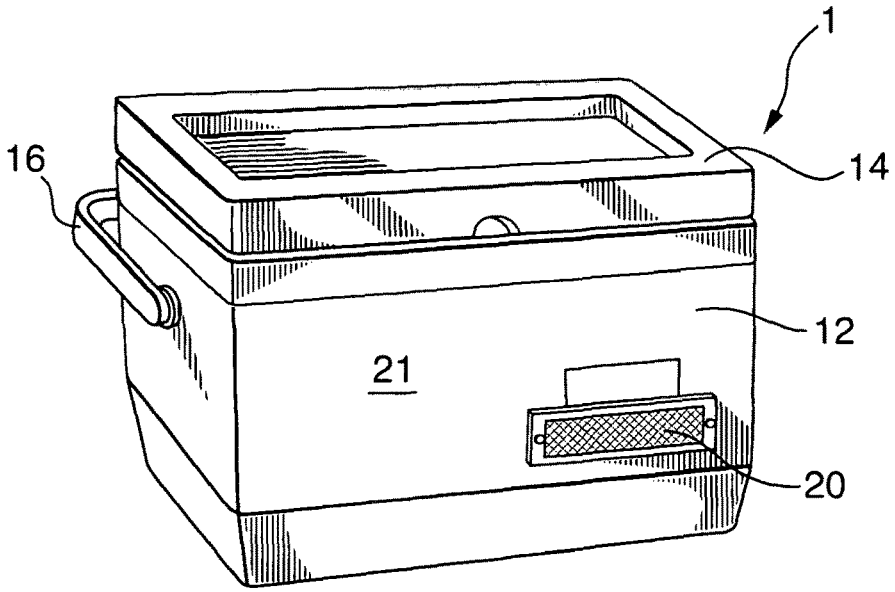
FIG. 2 is a perspective view of the ATCE carrier.
Figure 3:
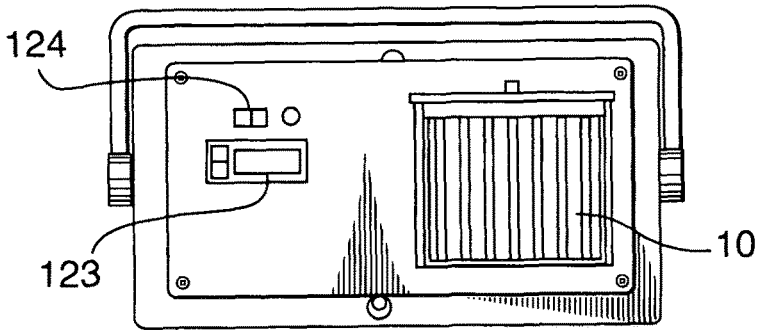
FIG. 3 is a top view of the ATCE carrier with the enclosure lid removed.
Figure 4:
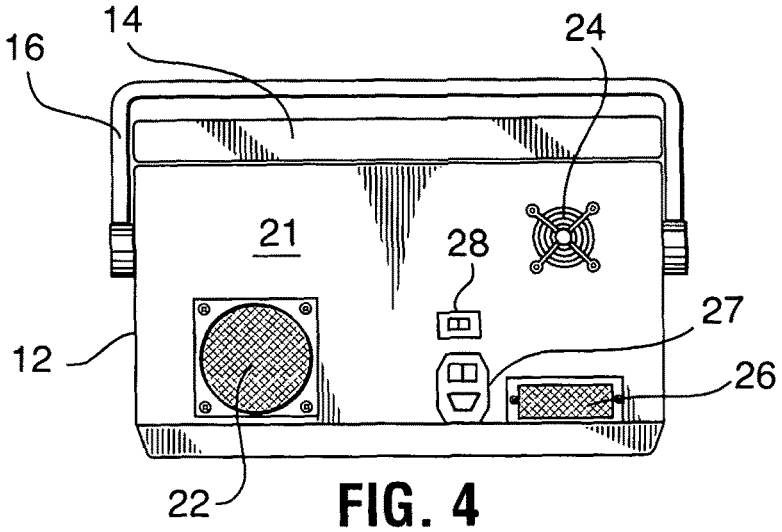
FIG. 4 is a rear plan view of the ATCE carrier.
Figure 5:
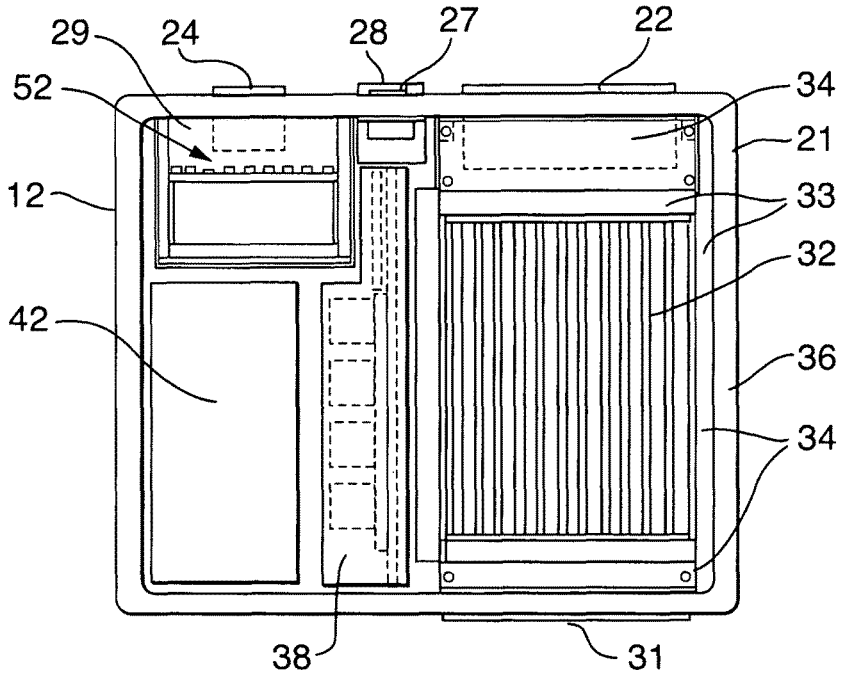
FIG. 5 is a top view of the ATCE carrier with the top panel removed showing the heat chimney/power supply assembly, battery, auxiliary electronics module, insulation panels, and thermal manifold product enclosure assembly.
Figure 6:
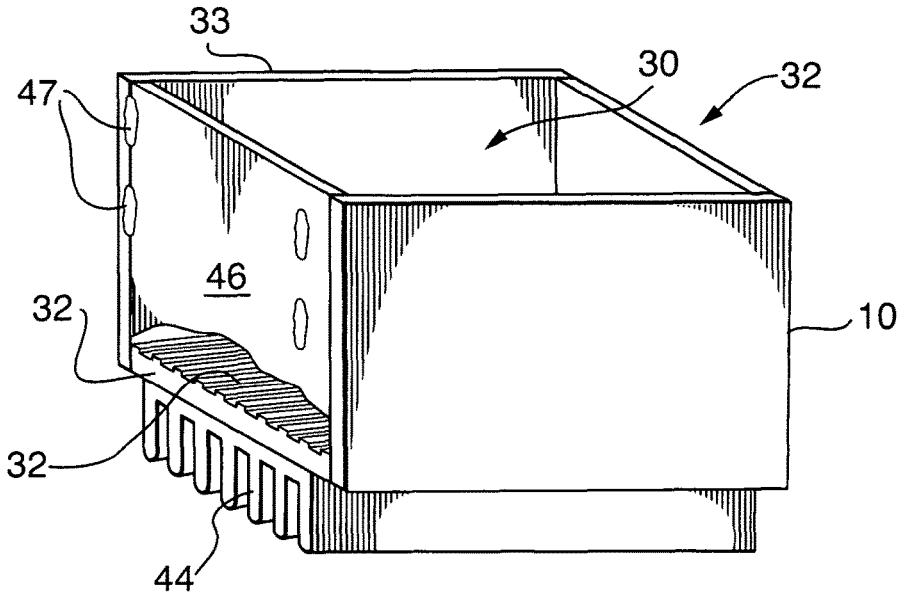
FIG. 6 is a perspective view of the thermal manifold product enclosure.
Figure 7:
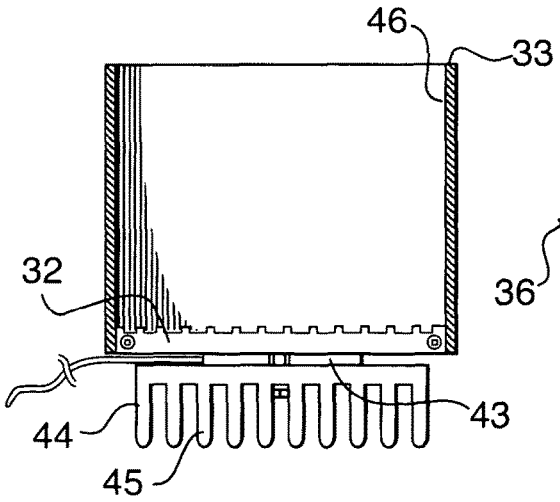
FIG. 7 is a side view of the thermal manifold enclosure of FIG. 6.
Figure 8:
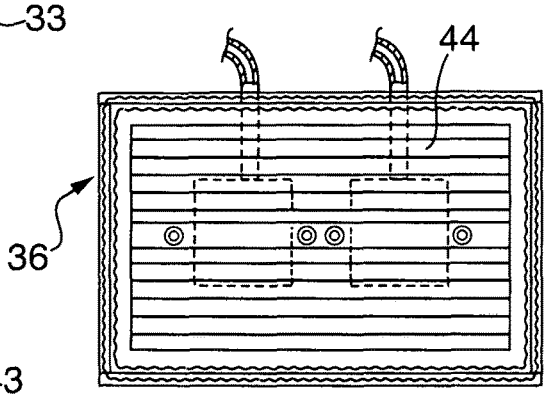
FIG. 8 is a bottom view of the thermal manifold enclosure of FIG. 6.
Figure 9:
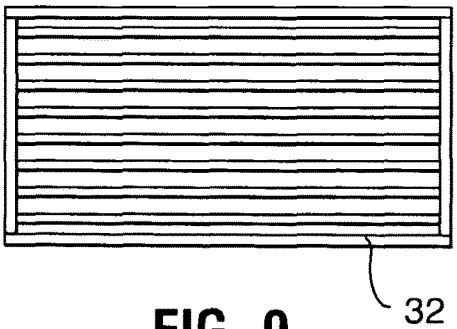
FIG. 9 is a top view of the thermal manifold enclosure of FIG. 6.
Figure 10:
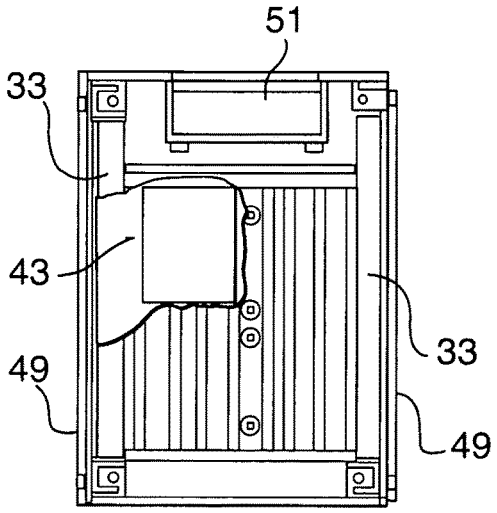
FIG. 10 is a bottom view of the thermal manifold enclosure with a thermo-electric peltier device shown in a cutaway view.
Figure 11:
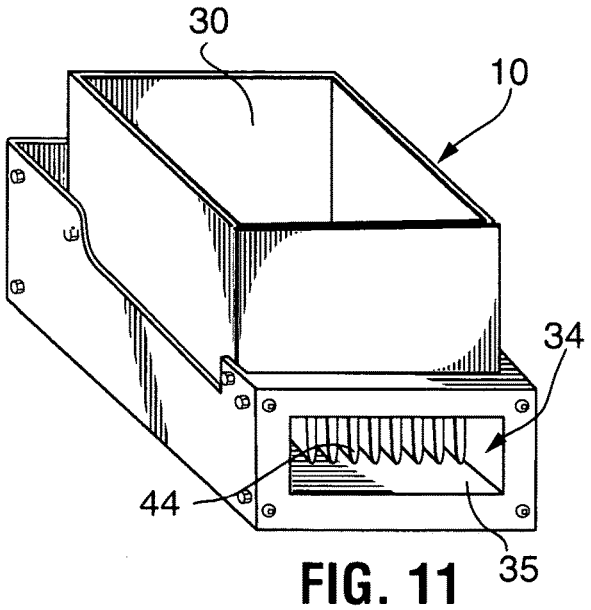
FIG. 11 is a perspective view of the thermal manifold enclosure, thermal cavity, heat sink, and plenum.
Figure 12:
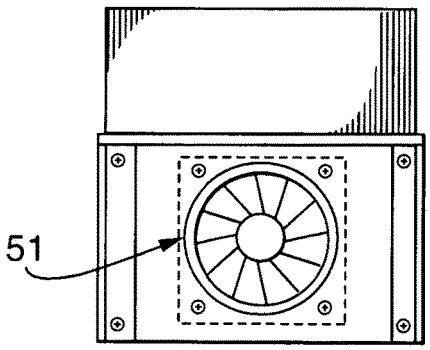
FIG. 12 is an end view of FIG. 11.
Figure 13:
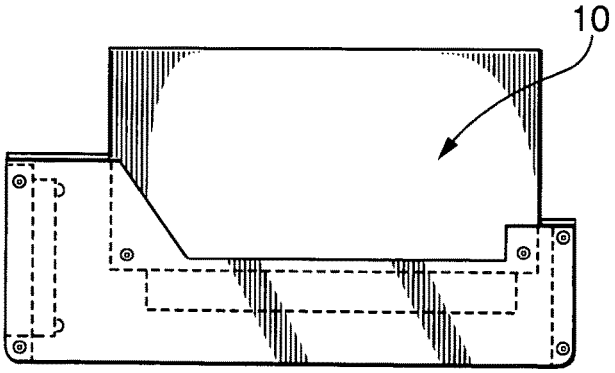
FIG. 13 is a side view of FIG. 11.
Figure 14:
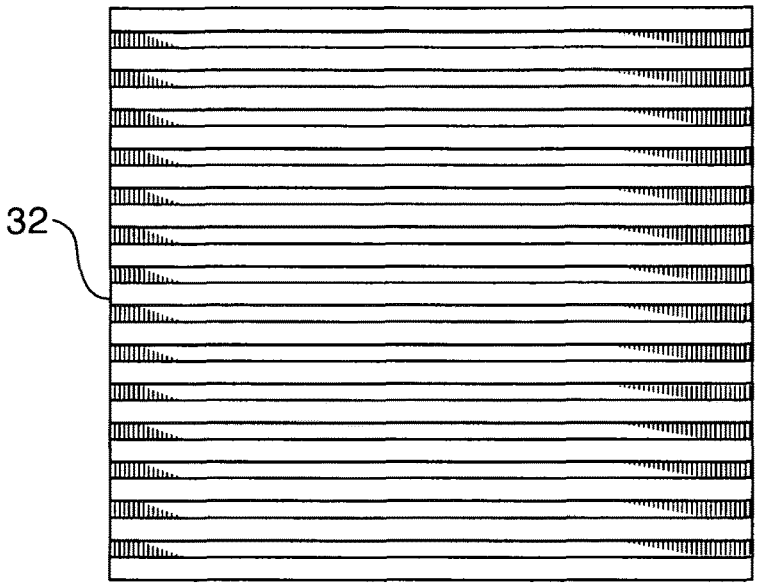
FIG. 14 is a top view of the thermal transfer manifold surface.
Figure 15:
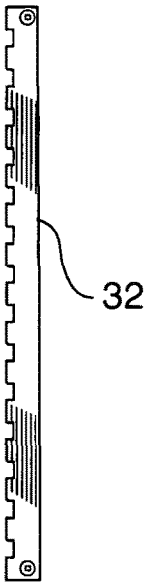
FIG. 15 is a side edge view of the thermal transfer manifold surface of FIG. 14.
Figure 16:
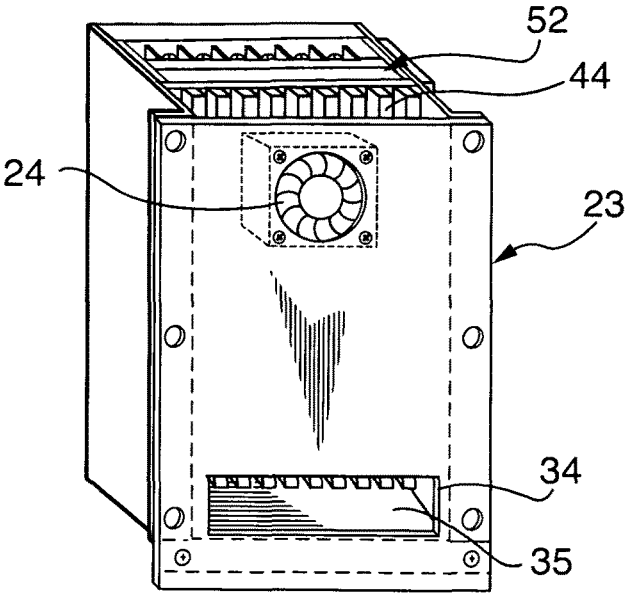
FIG. 16 is a perspective view of the power supply and heat sink assembly.
Figure 18:
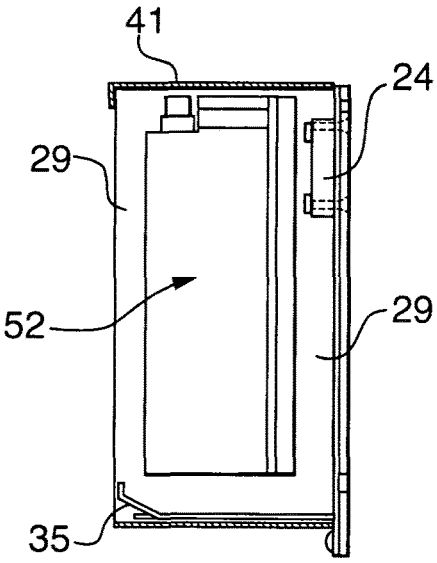
FIG. 18 is a side view of the power supply and heat sink assembly of FIG. 16.
Figure 17:
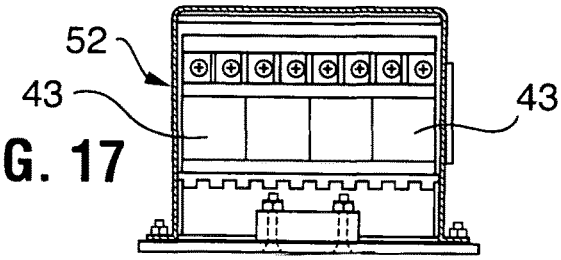
FIG. 17 is a top view of the power supply and heat sink assembly of FIG. 16.
Figure 19:
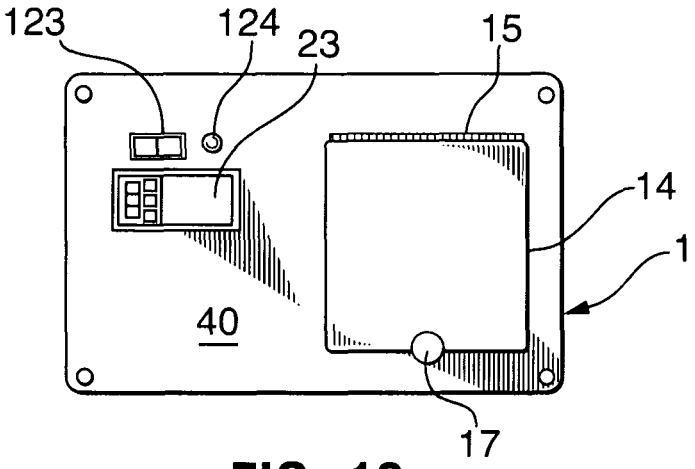
FIG. 19 is a top view of the carrier top panel assembly showing the switch, temperature controller, and lid or cover pivotally connecting to the top panel.
Figure 20:
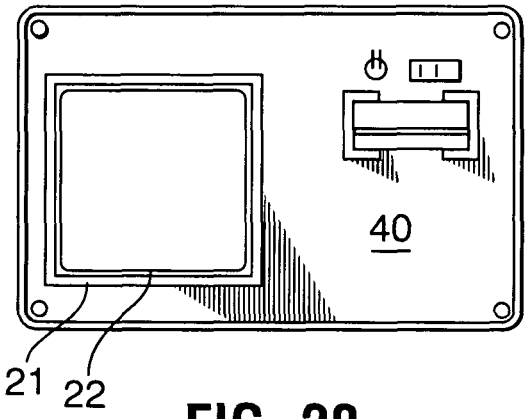
FIG. 20 is a bottom view of the carrier.
Figure 21:
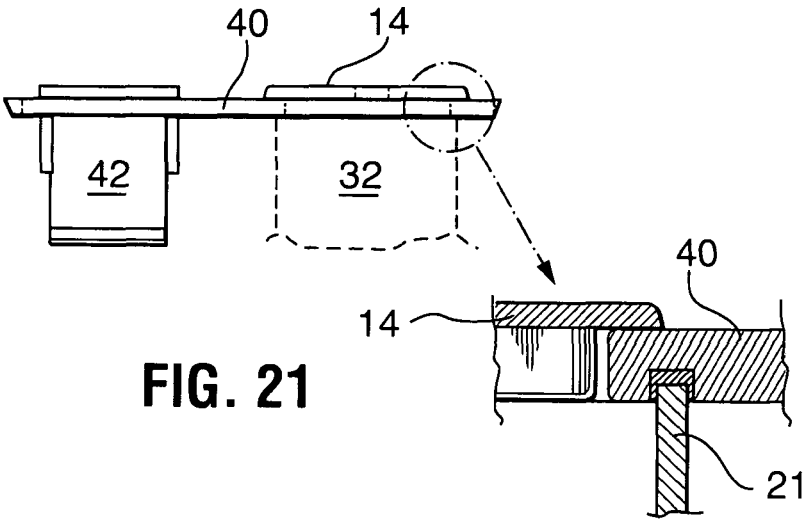
FIG. 21 is a side view of an edge of the carrier top panel of FIG. 19 showing the battery unit, thermal transfer manifold, and an insulated wall connecting to the top panel having a cover lid thereon.
Figure 22:
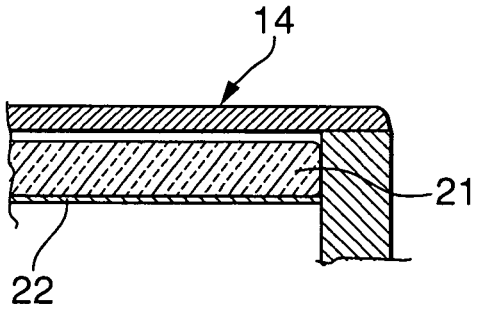
FIG. 22 is side view showing the top panel of FIG. 19 and an insulation pad disposed beneath the lid having a foil seal.
Figure 23:
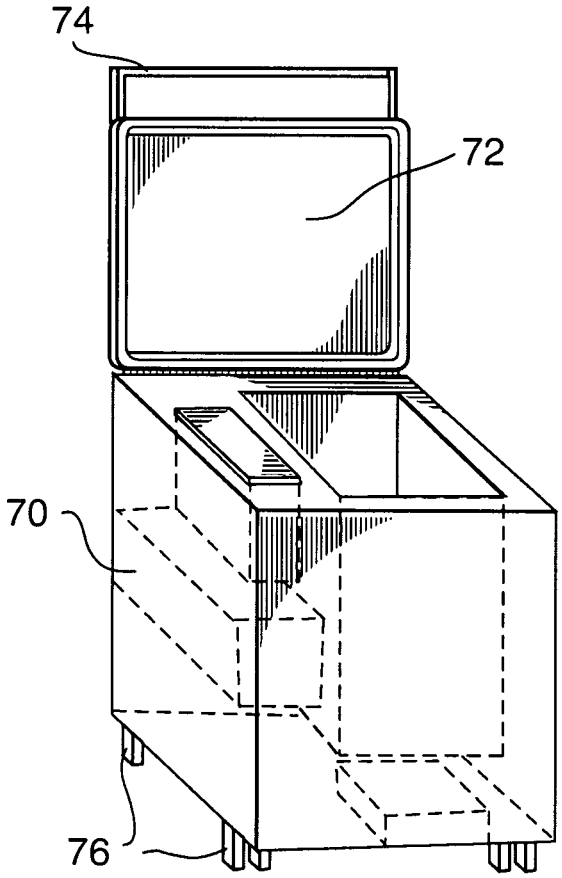
FIG. 23 is a perspective view of an alternate mobile carrier embodiment having wheels and a pull bar.
Figure 24:
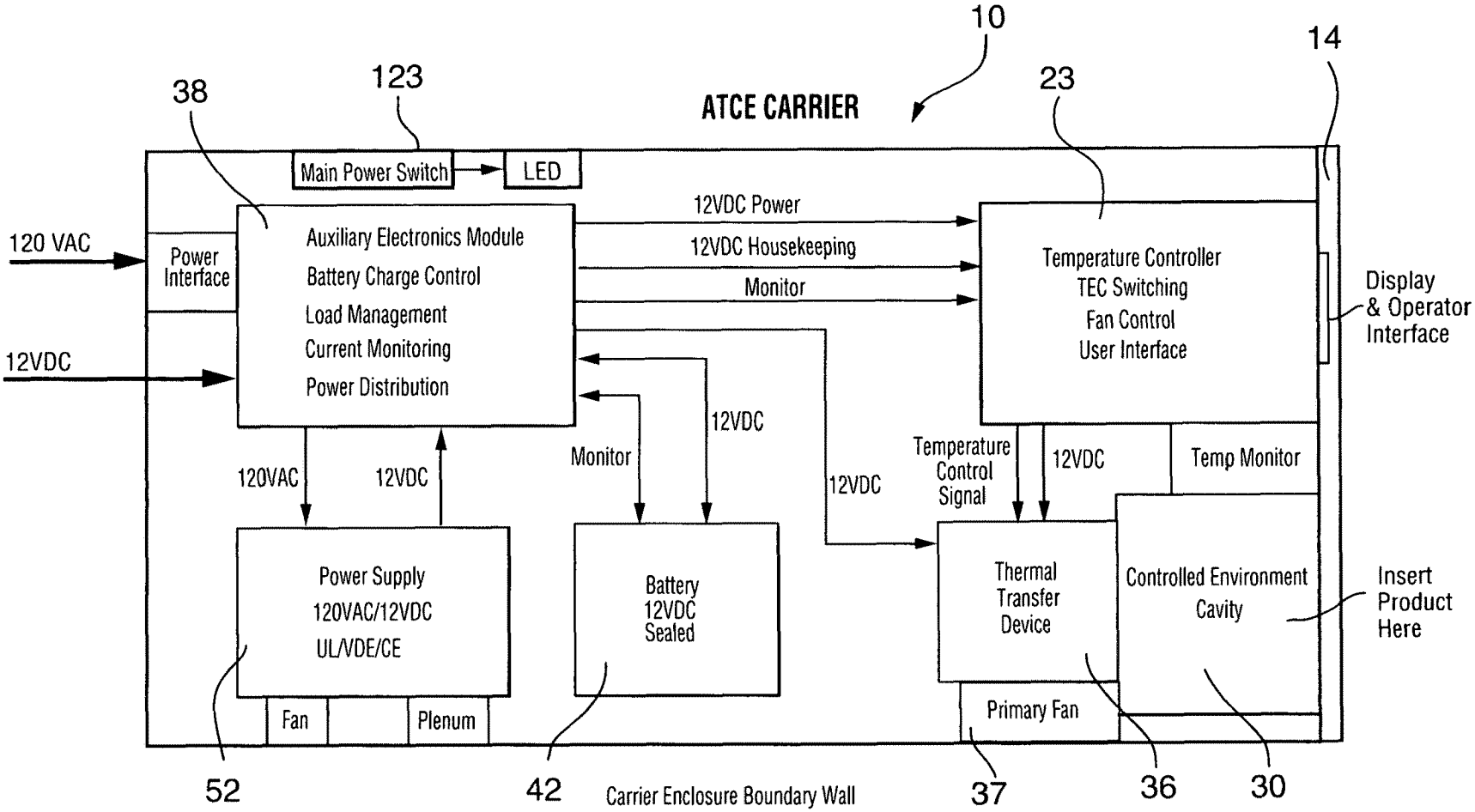
FIG. 24 is a block diagram of the subassemblies and the communication lines and power flow.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. Conventional electrical wiring is used to connect the electrically powered modules with the wiring omitted for clarity.

The automatic temperature-controlled enclosure ("ATCE") is partitioned into subassembly modules including a temperature controller assembly, thermal manifold enclosure module, power supply, thermal chimney module, battery, auxiliary electronics module disposed in a carrier enclosure.

The enclosure 1 includes a dual-wall, foam cavity. Wall penetrations are made for airflow inlets and outlets and external power connections. The carrier utilizes an insulated top panel for unit controls, monitoring, and access to the temperature controlled cavity. Access to the top panel is made by simply opening the lid 14 to the cooler enclosure.

Additional foam insulation panels 33 with reflective foil are utilized around the thermal manifold enclosure subassembly 10 to further stabilize the enclosure temperature-controlled cavity 30 and to force the convective heat/cool energy transfer to the desired enclosure space. Internal areas with controlled airflow cavities are mounted in the cooler enclosure with foam edge boundaries, which effectively seal the areas against airflow escape. This insulation, along with the dual-wall cooler enclosure construction, provides resistance against external ambient temperatures.

The portable, self-contained, automatic temperature-controlled enclosure (ATCE) is referred to as the ATCE carrier 1. The carrier comprises of a dual-wall, foam cavity portable cooler. Cooler wall conduits and penetrations are made for airflow inlets via front inlet grill 31 and outlets and external power connections. The enclosure, from hereon, also referred to as the automatic temperature controlled enclosure (ATCE) carrier utilizes a top panel for unit controls, monitoring, and access to the temperature controlled cavity. Access to the top panel 40 is made by opening the lid 14 connected by a hinge 15 to the carrier 1 by the lift tab 17. Carrier wall Insulation panels or pads 21 are comprised of insulating material such as foam which may include a reflective foil 22 around the thermal transfer device 10 or thermal cavity subassembly to further stabilize the temperature-controlled cavity 30 and to force the convective heat/cool energy transfer to the desired thermal cavity space. Internal areas with controlled airflow cavities are mounted in the thermal cavity with foam edge boundaries, which effectively seal the areas against airflow escape. This insulation, along with the dual-wall cooler thermal cavity construction, provide resistance against external ambient temperatures.

The internal sub-frame is constructed to support the operating modules and the top panel for the user interface on the controller 23 and internal cavity opening. The walls 46 of the thermal cavity 30 are surrounded by foam insulation, for example the thermal enclosure insulation panels 33 providing temperature stability against external ambient conditions. The operating sub-frame is an integrated assembly that can be removed from the case 12 for servicing.

As seen in the drawings, the ATCE carrier 1 is partitioned into major subassembly modules: temperature controller 23, thermal transfer device 32, thermal manifold enclosure assembly 10 including enclosure cavity 30, power supply module 52, battery 42, and auxiliary electronics module 38. The thermal manifold enclosure assembly 10 includes the thermal cavity 30 which holds the items, such as bottles of wine whose temperature is to be controlled, a lid 14, insulation panels 31 around the walls of the cavity 30 and in the lid 14, and an external case or housing 12 surrounding and containing all of the subassembly modules. A pivotal handle 16 is provided for carrying the ATCE carrier 1.

In one travel embodiment, the external case 1 of the carrier 70 includes wheels or casters 76 at the bottom four corners, and an extended handle 74 for pulling the ATCE carrier 1.

Temperature Controller

The Temperature Controller consists of an off-the-shelf commercial/industrial programmable thermostatic controller that incorporates remote temperature sensing and closed loop heating/cooling control outputs. The controller 23 contains a visual display and user controls for the current temperature and the set point temperature, temperature alarm settings, and thermostat control function settings. The user interface is primarily through this module for the programming of desired temperature and allowable temperature range for the material being transported. This module utilizes 12 VDC system power for operation and provides controlled switch outputs for heating and cooling signals to the thermo-electric module 32. The controller 23 operates similar to a precision programmable thermostat, issuing a cooling control signal when the device cavity 30 temperature is above the user-defined set point, and issues a heating control signal when the device cavity 30 temperature is below the set point. Alarm set points are user defined and can signal if the temperature in the cavity deviates beyond the range defined by the user.

The bidirectional temperature controller 23 consists of a programmable thermostatic controller that incorporates remote temperature sensing and closed loop heating/cooling control outputs. The controller 23 contains a visual display and user controls for the current temperature and the set point temperature, temperature alarm settings, and thermostat control function settings. As shown in the figures, the unit is activated by switch 123. An LED indicator power indicator with bezel 124 is positioned in close proximity to the controller 123. The user interface on the controller 23, accessible under the lid 14, is for the programming of desired temperature and allowable temperature range for the material being transported. This module utilizes 12 VDC system power for operation and provides controlled switch outputs for heating and cooling signals to the thermal transfer device 36, which includes the lower heat sink 44 having a plurality of fins 45, the Peltier device 43 and the thermal manifold 32. The controller 23 operates in a similar manner to a precision programmable thermostat, issuing a cooling control signal when the device cavity temperature is above the user-defined set point, and issues a heating control signal when the device cavity temperature is below the set point. The alarm set points are user defined and can signal a users cell phone through BLUE TOOTH or WIFI connectivity if the temperature in the cavity deviates beyond the range defined by the user.

Thermal Manifold/Enclosure Module

The Thermal Manifold/Enclosure module 36 is a bi-directional heating, cooling, and energy transfer device based upon the Peltier effect using thermo couples to move heat from one location to another. for thermal energy conversion. A Peltier device or assembly of thermoelectric devices 43 includes at least one and preferably a plurality of thermo-electric devices, "TEC" devices. A simple TEC device comprises a two wired, two sided device such as a disc including several thermocouples wherein electrical current forced in one direction causes heat to move from one side of the device to the other, while reversing the direction of the current cause heat to move in the opposite direction. In the ATCE carrier 1, a plurality of multiple thermo-electric devices, ("TEC") device or Peltier devices 43 are mounted to an assembly consisting of a heat sink 44 on one side of the Peltier devices and a heat manifold 32 on the other side of the Peltier devices 43. The heat transfer device transfers the cooling, or heating, from the lower heat sink 44 through the Peltier devices 43, through the manifold 32 and on into the enclosed cavity 30. The temperature is monitored in the cavity for feedback to the temperature controller 23. The bi-directional heat flow capability is facilitated through the polarity of power applied to the Peltier (TEC) devices. Power routing to the module flows through the auxiliary electronics module 38, controlled by the temperature controller 23 with user interface. The heat sink 44 and heat manifold 32 include high thermally-conductive aluminum alloys to efficiently move heat and cool through the TEC system to the product cavity 30 utilizing a combination of conductive and convective heat transfer principles. Forced air flow for the heat sink side is provided by a ducted fan 51 over the fins of the lower heat sink 44 and through the plenum 34. The forced air is pulled in through vent 22 and vented to the outside through vent 20 to prevent heat buildup inside the enclosure 10. This plenum 34 is an integral part of the internal cavity and the thermal transfer device 36 is custom designed utilizing an air deflector 35 to maximize thermal flow from the Peltier devices to the cavity space 30.

In the device, this module is a proprietary designed bi-directional heat flow manifold, consisting of multiple industrial thermo-electric devices (TEC) mounted to manifold/enclosure assembly consisting of a custom heat sink on one side and an application-specific custom heat manifold on the other side. The proprietary heat manifold transfers the cooling or heating energy from the TEC devices through the manifold and radiates it to the enclosure cavity. The temperature is monitored in the enclosure cavity for feedback to the Temperature Controller. The bi-directional heat flow capability is facilitated through the polarity of power applied to the TEC devices. Power routing to the module flows through the Auxiliary Electronics module, controlled by the Temperature Controller and user interface. The heat sink and thermal manifold/enclosure utilize high thermally-conductive aluminum alloys to efficiently move heat and cool through the TEC system to the enclosure cavity utilizing a combination of conductive and convective heat transfer principles. Forced air flow for the heat sink side is provided by a ducted fan controlled through from the Auxiliary Electronics module. The forced air is vented to the outside to prevent heat buildup inside the carrier enclosure. This module is an integral part of the internal cavity and the manifold is uniquely designed to maximize thermal flow from the TEC devices to the cavity space.

The thermal manifold enclosure module 10 is utilizes a novel five-sided thermal radiating enclosure, with an insulated, thermally reflective top cover 41 and side panels 49. Special channels are machined into the primary transfer surface (bottom surface) that increase the surface area for contact conduction and open convective transfer. The side walls of the manifold/enclosure are TIG welded together and to the primary thermal transfer surface to provide a low thermal-resistance path for energy transfer throughout the enclosure cavity.

The power supply module 52 is air cooled with a small fan 24 which input vent 26 and converts AC line voltage input or interface connector 28, to regulated 12 VDC internal power. An alternate DC voltage adapter or interface connector 27 and circuitry is provided as well. This provides internal operating power and charging power to the battery module 42. The power supply 52 is of high-efficiency switching design, and includes over-voltage, under-voltage, over-current, and operating temperature protection within the module. The charging power for the battery 42 is routed through the auxiliary electronics module 38 where it is monitored and controlled.

The battery module 42 provides power to the device when the enclosure 10 is being transported. The battery module 42 utilizes commercial sealed, lead-acid (SLA), deep cycle batteries in a parallel connection arrangement. The amp-hour rating is sized for the planned utilization time of the device, and multiple batteries are used for extended operation. Connectors are utilized to facilitate ease of replacement of the batteries in the system. Charging of the batteries is controlled through the auxiliary electronics module 38.

The auxiliary electronics module 38 contains electronic circuitry to tie together the electrical controls within the device, power routing, and the housing and powering of optional functions such as GPS location beacons and cellular communications. This module consists of a printed circuit board assembly containing the control circuitry, connectors for interface to the device, power switching relays for power control, and voltage conversion where required to service option functions that require voltages other than 12 VDC.

The auxiliary electronics module 38 is housed in a vented, plastic enclosure for protection of the printed wiring board and associated circuitry. Power from the power supply module 52, battery module 42, and external 12 VDC vehicle power input are routed through the auxiliary electronics module 38 where they are monitored, controlled, and routed as required to the other modules in the device. Status monitoring of the power mode being utilized, battery charging and battery module health, internal device temperature safety controls, and option module control and power are contained in the module. For optional high-end versions of the device, a programmable controller function is included in the circuit board that provides enhanced control and interface functions. This controller is accessed through USB connection to the top control panel user interface. The controller uses pre-installed firmware to control the functions of the device.

Another embodiment of the ATCE carrier 1 includes a programmable controller function that provides enhanced control and interface functions. This controller is accessed through USB connection to the top control panel user interface on the controller 23. The controller uses pre-installed firmware to control the functions of the device. The controller includes GPS location detection tracking and cell phone communication capability.

One embodiment of the portable, self-contained, temperature-controlled enclosure includes an app which can be accessed through a cell phone link enabling a cell phone user to dial up the ATCE carrier and retrieve location data, temperature data, and past and present alarm history. The user can also change the temperature program within the controller, as desired.

The case 12 is constructed in a similar manner to an airline carry-on rolling bag, consisting of an internal subframe with a preferably nylon outer surface. One embodiment includes wheels 76 on the bottom to facilitate movement and an extending pull handle 42.

As can be seen in block diagram, all of the subassemblies are in electrical communication with one another. The straight lines with arrow points are electrical communication paths and the curved lines connect the subassemblies with the identifying numerals used in the application. Power from the battery 42 and power supply 52 is delivered to the auxiliary electronics module and from there to the other subassemblies. Temperature in the controlled environment cavity 30 is monitored by the temperature controller which in turn sends control signals to the thermal transfer device 37 to maintain control of the temperature in the cavity 30.

Operation

The device is straightforward in operation, not requiring any special technical skills. The user would open the top cover, turn on the device through the user interface, and set the desired temperature via buttons on the temperature controller, using the display to view the settings. Once set, the user would place their material needing transport into the enclosure cavity, and then close the cover. Operating instructions for the device will recommend that the material to be transported already be at or close to the desired temperature from its non-portable storage location. This will maximize the operational time of the device.

The user has the option of using battery power (internal self-powered), vehicle power through an accessory outlet and interconnect cable (12 VDC vehicle power), or use normal household AC power through a wall outlet and power cord if it is available. The device will sense what type of power is being used and control operations accordingly. When the device reaches the end of its operating time (self-powered), or experiences an operating problem, it will signal an alarm prior to going into shutdown mode to alert the user.

When the user is ready to remove the materials, they simply open the cover and remove the material from the cavity. At this point, there is the option to allow the device to continue running if desired (anticipate will be needed again soon), or simply to turn the unit off if it will not be needed. The device requires to be plugged into AC power to properly charge the internal batteries. High-end versions of the device that contain options such as cellular communication and GPS will have additional user-prompted controls, and for custom programming will require connection through USB cable to an external smart device. These operating modes would be detailed in the owner's manual.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A portable and rechargeable temperature controlled case, comprising:

a carrier enclosure partitioned into a plurality of subassembly modules and having a dual wall thermal cavity formed therein, said thermal cavity having four foam insulated dual walls, a first insulated top lid, and a bottom, said bottom comprising a thermal manifold said thermal manifold having a top surface wherein said top surface forms an inside bottom surface of said thermal cavity, a plurality of peltier devices connected in thermal communication to a bottom side of said thermal manifold, a lower heat sink connected in thermal communication to a bottom surface of said plurality of peltier devices providing bi-directional heat flow transfer to said thermal cavity including a heat sink on one side and an application-specific custom heat manifold on the opposing side, said enclosure including the following subassemblies:

a temperature controller with an integrated user interface, said temperature controller controlling said plurality of peltier devices in order to maintain a target temperature within said thermal cavity;

a thermal transfer device for heating or cooling said thermal cavity, said thermal transfer device including said plurality of peltier devices, said thermal manifold, said lower heat sink, and a fan for forcing air for the heat sink side vented to the outside to prevent heat buildup inside the carrier enclosure, a power supply module comprising a two stage thermal engine to both heat and cool;

a rechargeable battery in electrical communication with said power supply, said temperature controller and said thermal transfer device;

an auxiliary electronics module for electrically connecting said subassemblies to one another;

said carrier enclosure defining an external case including four walls extending upward from a base, and a second lid, and containing said subassembly modules and said thermal cavity for removably holding temperature sensitive articles;

said first lid cooperatively engaging said thermal cavity for forming an air tight seal with a top edge of said insulated walls of said thermal cavity;

at least one side handle extending from an outside surface of at least one side wall of said enclosure;

means for transmitting and receiving instantaneous thermal cavity temperature and humidity and history at selected intervals and location wirelessly in real time or recorded including GPS location tracking, USB connectivity, BLUE TOOTH and WIFI connectivity, said means for transmitting and receiving information wirelessly capable of transmitting enclosure location to connected devices including cell phones, tablets, computers and WIFI capable electronic devices; and a system processor for controlling said temperature controller, said thermal transfer device, and said power supply.

2. The portable and rechargeable temperature controlled case of claim 1, wherein said temperature controller further includes a programmable thermostatic controller including remote temperature sensing and closed loop heating and cooling control outputs, a visual display, a control for current temperature and set point temperature, a temperature alarm setting, a thermostat control function setting, a 12 volt DC power system, and a programmable thermostat for issuing a cooling control signal upon the temperature of the cavity rising above a pre-set temperature and for issuing a heating control signal upon the temperature of the cavity falling below a pre-set temperature.

3. The portable and rechargeable temperature controlled case of claim 2, further including an alarm with selected set points for activating said alarm if the temperature deviates beyond a selected range.

4. The portable and rechargeable temperature controlled case of claim 1, wherein said power supply is housed in a thermal chimney enclosure for drawing outside ambient air into said power supply enclosure and exhausting waste heat outside of a carrier enclosure.

5. The portable and rechargeable temperature controlled case of claim 1, wherein said power supply module monitor the status of the battery charging, battery health, internal device temperature safety controls, and power.

6. The portable and rechargeable temperature controlled case of claim 1, wherein said thermal manifold is surrounded with a plurality of foam insulation panels covered with a reflective foil.

7. The portable and rechargeable temperature controlled case of claim 1, wherein said power supply is selected from the group consisting of an onboard rechargeable battery, external DC power, or external AC power.

8. The portable and rechargeable temperature controlled case of claim 1, wherein said means for transmitting and receiving information wirelessly is selected from the group consisting of a system processor, a keyboard, a touch screen, and combinations thereof.

9. The portable and rechargeable temperature controlled case of claim 1, including at least one side handle extending from an outside surface of at least one side wall of said carrier enclosure.

10. The portable and rechargeable temperature controlled case of claim 1, wherein a plurality of channels are formed in a top surface of a bottom of the thermal cavity increasing the surface area for contact conduction and open convective heat transfer.

11. The portable and rechargeable temperature controlled case of claim 1, wherein at least one peltier device connecting said lower heat sink to said thermal manifold for moving heat either from said lower heat sink upward to the thermal manifold or moving heat from said thermal manifold downward to said lower heat sink.

12. The portable and rechargeable temperature controlled case of claim 11, wherein said lower heat sink is situated in a plenum wherein said fan circulates ambient air there over.

13. A portable and rechargeable temperature controlled case consisting of:

a carrier enclosure partitioned into a plurality of subassembly modules and having a dual wall thermal cavity formed therein, said thermal cavity having foam insulated dual walls, a first insulated top lid, and a bottom, said bottom comprising a thermal manifold said thermal manifold having a top surface wherein said top surface forms an inside bottom surface of said thermal cavity, a plurality of peltier devices connected in thermal communication to a bottom side of said thermal manifold, a lower heat sink connected in thermal communication to a bottom surface of said plurality of peltier devices providing bi-directional heat flow transfer to said thermal cavity including a heat sink on one side and an application-specific custom heat manifold on the opposing side, said enclosure including the following subassemblies:

a temperature controller with an integrated user interface, said temperature controller controlling said plurality of peltier devices in order to maintain a target temperature within said thermal cavity;

a thermal transfer device for heating or cooling said thermal cavity, said thermal transfer device including said plurality of peltier devices, said thermal manifold, said lower heat sink, and a fan for forcing air for the heat sink side vented to the outside to prevent heat buildup inside the carrier enclosure;

a power supply module comprising a two stage thermal engine to both heat and cool;

a rechargeable battery in electrical communication with said power supply, said temperature controller and said thermal transfer device;

an auxiliary electronics module for electrically connecting said subassemblies to one another;

said carrier enclosure defining an external case including four walls extending upward from a base, and a second lid, and containing said subassembly modules and said thermal cavity for removably holding temperature sensitive articles;

said first lid cooperatively engaging said thermal cavity for forming an air tight seal with a top edge of said insulated walls of said thermal cavity;

at least one side handle extending from an outside surface of at least one side wall of said enclosure;

means for transmitting and receiving instantaneous thermal cavity temperature and humidity and history at selected intervals and location wirelessly in real time or recorded including GPS location tracking, USB connectivity, BLUE TOOTH and WIFI connectivity, said means for transmitting and receiving information wirelessly capable of transmitting enclosure location to connected devices including cell phones, tablets, computers and WIFI capable electronic devices; and a system processor for controlling said temperature controller, said thermal transfer device, and said power supply.

* * * * *